US006019626A

United States Patent [19]

Abe

[11] Patent Number: 6,019,626

[45] **Date of Patent: *Feb. 1, 2000**

[54] CONTACT TERMINAL

[75] Inventor: Kimihiro Abe, Shizuoka, Japan

[73] Assignee: Yazaki Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/908,172

[22] Filed: Aug. 7, 1997

[30] Foreign Application Priority Data

Aug. 8, 1996 [JP] Japan ..... 8-210125

[51] Int. Cl.[7] ..... H01R 4/24

[52] U.S. Cl. ..... 439/399; 439/407

[58] Field of Search ..... 439/397, 398, 439/399, 400, 406, 407

[56] References Cited

U.S. PATENT DOCUMENTS

| | | | |
|---|---|---|---|
| 4,385,794 | 5/1983 | Lucius | 439/399 |
| 4,940,425 | 7/1990 | Hass et al. | 439/406 |
| 5,129,840 | 7/1992 | Kuzuno | 439/397 |
| 5,133,672 | 7/1992 | Nelligan | 439/399 |
| 5,344,336 | 9/1994 | Sampson | 439/399 |
| 5,549,483 | 8/1996 | Hotea | 439/399 |

FOREIGN PATENT DOCUMENTS 59-226477 12/1984 Japan .

*Primary Examiner*—Michael L. Gellner
*Assistant Examiner*—Antoine Ngandjui
*Attorney, Agent, or Firm*—Sughrue, Mion, Zinn, Macpeak & Seas, PLLC

[57] ABSTRACT

A contact terminal includes an electrically conductive plate including a base plate; an electrical contact section, engageable with another terminal, formed at a front end portion of the base plate; a wire clamping section, for clamping a wire thereto, formed at a rear end portion of the base plate; an electrically conductive section formed between the electrical contact section and the wire clamping section, the electrically conductive section including first and second side walls and a bottom wall which is a part of the base plate and is formed between the first and second side walls, the first and second side walls which have first and second blades extending inwardly to confront each other so as to define a slot therebetween; and a step portion formed in the base plate between the electrical contact section and the wire clamping section so that a section of the base plate in the step portion in the front-to-rear direction is non-linear.

7 Claims, 4 Drawing Sheets

CONTACT TERMINAL

BACKGROUND OF THE INVENTION

1. Field of the Invention

This invention relates to a contact terminal which is so designed that, when a covered conductor (or electrical wire) is press-fitted into a slot, the internal conductor is brought into contact with the terminal without removal of the insulating cover of the covered conductor.

2. Background

FIG. 7 is a perspective view showing a conventional contact terminal disclosed by Unexamined Japanese Patent Publication No. Sho. 59-226477.

In FIG. 7, reference numeral 1' designates the aforementioned conventional contact terminal. The contact terminal 1' is formed integrally by pressing a thin metal plate which is punched. The front end portion of the contact terminal is an electrical contact section 2' which is engaged with a mating terminal, and its rear end portion is a wire clamping section 3', and the middle portion between the front and rear end portions is an electrically conductive section 4'. More specifically, the electrical conductive portion 2' is engaged with the mating terminal so as to be electrically connected with each other; the wire clamping section 3' has right and left retaining pieces (parts of the walls) 3*a*', which are bent inwardly to fixedly hold a wire W from the above; and the electrically conductive section 4' is electrically connected to the conductor of the wire W. The wire clamping section 3' is coupled through a first neck 7" to the electrically conductive section 4', and the electrically conductive section 4' is coupled through a second neck 7' to the electrical contact section 2'.

The electrically conductive section 4' has a front insulation piercing portion 10A' and a rear insulation piercing portion 10B' which are arranged at the front and rear ends thereof. The front insulation piercing portion 10A' has contact blades 11' and 11' which are confronted with each other in such a manner as to form a slot 12' between them into which the conductor (core) of the wire W is inserted. Similarly, the rear insulation piercing portion 10B' also has contact blades 11' and 11' which are confronted with each other in such a manner as to form a slot 12' between them into which the conductor of the wire W is inserted.

The wire clamping section 3', the electrically conductive section 4', and the electrical contact section 2' have a common bottom wall having the first neck 7" and the second neck 7'. The common bottom wall is a belt-shaped flat plate. The electrically conductive section 4' is substantially U-shaped in section. More specifically, the electrically conductive section 4' has a part of the common bottom wall which is provided between the first neck 7" and the second neck 7', and right and left side walls 9' and 9' which extend upwardly from the right and left edge portions of the bottom wall, respectively. The insulation piercing blades 11' of the insulation piercing portions 10A' and 10B' are respectively formed by bending inwardly the front and rear end portions of the side walls 9'.

The wire W is connected to the contact terminal as follows. First, one end portion of the wire W is laid on the rear end portion of the contact terminal 1' in such a manner that the one end portion of the wire W is in parallel with the rear end portion of the contact terminal 1'. Under this condition, the one end portion of the wire W is pushed in the slots 12' of the electrically conductive section 4' from the above. Accordingly, the right and left blades 11' cut the insulating cover of the wire W, and contact the conductor of the wire W. When the one end portion of the wire W is further pushed in, the conductor of the wire W is moved to be between the right and left blades 11', so that the conductor is more positively held by the right and left blades 11'. In this operation, a force is applied to the right and left blades 11' so that the blades are moved away from each other.

In general, a contact terminal is mass-produced, and a number of contact terminals are built in a connector housing in such a manner that they are adjacent to one another. Hence, there has been a strong demand for the provision of a contact terminal which is small in size, and light in weight. In order to decrease the weight of the contact terminal, it is essential to reduce the thickness of a metal plate which is formed into the contact terminal. And in order miniaturize the contact terminal, it is necessary to decrease the width and the length of the contact terminal. For instance, in order to decrease the width of the contact terminal, it is essential to decrease the width of the insulation piercing blades forming the slot.

However, if the thickness of the metal plate, which is a raw material for the contact terminal, is decreased, the width of the insulation piercing blades is decreased, then the mechanical strengthof the blades is also decreased, as a result of which, when the wire is pushed in the slot, the right and left blades are opened outwardly.

In view of the foregoing, in the conventional contact terminal shown in FIG. 7, the insulation piercing blades 11' are respectively formed by bending inwardly the front and rear end portions of the side walls 9' of the electrically conductive section 4'. However, the force, acting on the blades 11' when the wire W is press-fitted into the slots 12', acts through the side walls 9' on the bottom wall to bend the bottom wall in a curved condition in a lateral (right-to-left) direction. Therefore, if the bending rigidity of the bottom wall is low, there is a possibility that the side walls 9' are bent outwardly, and accordingly, the blades 11' are bent outwardly.

SUMMARY OF THE INVENTION

Accordingly, an object of the invention is to elimnate the above-described difficulties accompanying a conventional contact terminal.

More specifically, an object of the invention is to provide a contact terminal which is miniaturized, and in which the bottom wall supporting the side walls of the electrically conductive section is increased in rigidity, to prevent the side walls from being bent outwardly thereby to prevent the insulation piercing blades from being opened outwardly; that is, to improve the reliability in electrical connection of the contact terminal.

The foregoing object and other objects of have been achieved by a contact terminal which electrically conductive plate including: a bottom wall; an electrical contact section, engageable with another terminal, formed at a front end portion of the bottom wall; a wire clamping section, for clamping a wire thereto, formed at a rear end portion of the bottom wall; an electcally conductive section formed between the electrically section and the wire clamping section, the electrically conductive section including first and second side walls, the first and second side walls which have first and second insulation piercing blades extending inwardly to confront each other so as to define a slot therebetween; and a step portion formed in the bottom wall between the electrical contact section and the wire clamping section so that a section of the bottom wall in the step portion in the front-to-rear direction is non-linear.

In the contact terminal as was described above, since the section of the bottom wall is non-linear including the bent portion, the bottom wall is high in bending rigidity in the front-to-rear direction.

Further, the contact terminal includes a coupling section provided in one of spaces between the electrically conductive section and the wire clamping section and electrically the electrically conductive section and the electrical contact section, the coupling section which has the step portion formed in the bottom wall of the coupling section.

Also, the first and second side walls upwardly extend from both side edges of the base plate.

In the contact terminal, merely by providing the step portion in the bottom wall of the coupling section, the bottom wall is increased in rigidity. In addition, since the first and second side walls of the bottom wall where the step portion is located are bent upwardly, the junctions of the bottom wall and the side walls are increased in rigidity, which positively prevents the side walls from falling aside. Furthermore, the side walls of the electrically conductive section and the coupling sections are continuous to one another; that is, the side walls of the electrically conductive section are restricted by the side walls of the coupling sections, which prevents the side walls of the electrically conductive section from falling aside.

Further, in the contact terminal, the first and second side walls have first openings, respectively, and protrusions extended from front and rear edges of each of the first openings are bent inwardly to form the blades.

With the contact terminal as was described above, the first and second side walls of the electrically conductive section have the first openings, respectively, and the protrusions extended from the front and rear edges of each of the first openings are bent inwardly to form the blades. Hence, the peripheral portions of the side walls remain each in the form of a frame.

Moreover, in the contact terminal, the first and second side walls of the electrically conductive section have second openings in such a manner that the second openings are in alignment with the first openings, and protrusions extended from one of a front edge and a rear edge of the second openings are bent inwardly to form the blades.

In the contact terminal, owing to the first and second openings, at least three blades are provided in the front-to-rear direction. And those blades are continuous to one another, which prevents the blades from being opened outwardly.

BRIEF DESCRIPTION OF THE DRAWINGS

FIG. 4*a* is a diagram showing the bottom wall of the contact terminal of the invention which has a step, and FIG. 4*b* is a diagram showing the bottom wall of a conventional contact terminal which has no step;

DETAILED DESCRIPTION OF THE PREFERRED EMBODIMENTS

Preferred embodiments of the invention will be described with reference to FIGS. 1 to 6.

First Embodiment

An example of a contact terminal of a first embodiment of the invention, will now be described with reference to FIGS. 1 through 5.

Figure 5:
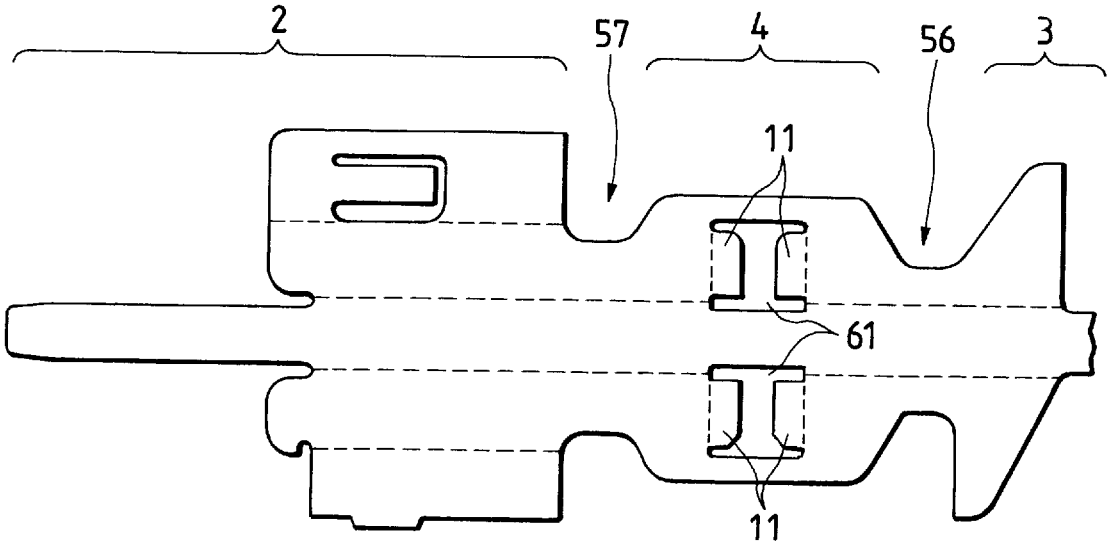
FIG. 5 is an unfolded diagram showing the contact terminal of the first embodiment of the invention.

In those figures, reference numeral 51 designates the contact terminal. The contact terminal 51 is formed integrally by pressing a piece of thin metal plate which is punched as shown in FIG. 5. As shown in FIGS. 1 through 3*c*, the contact terminal 51 includes an electrical contact section 2 at a front end portion thereof, a wire clamping section 3 at the rear end portion thereof, and an electrically conductive section 4 at the middle portion between the front and rear end portions.

The electrical contact section 2, the electrically conductive section 4, and the wire clamping section 3 have a common bottom wall 7 (described later).

Figure 1:
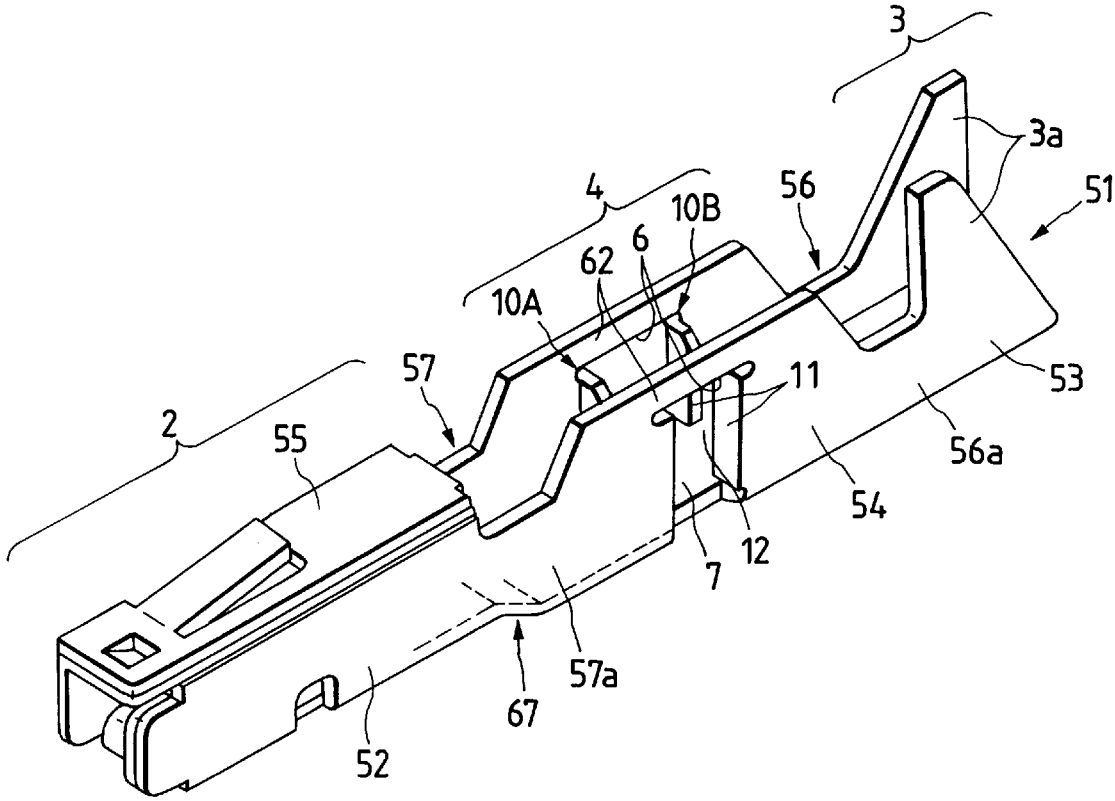
FIG. 1 is a perspective view of an example of a contact terminal of a first embodiment of the invention as viewed from obliquely above.
Figure 2:
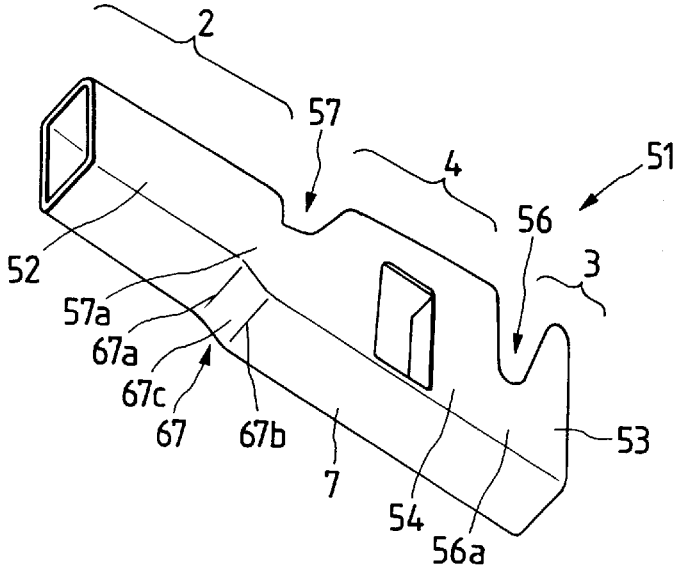
FIG. 2 is a perspective view of the contact terminal as viewed from obliquely below.
Figure 3A:
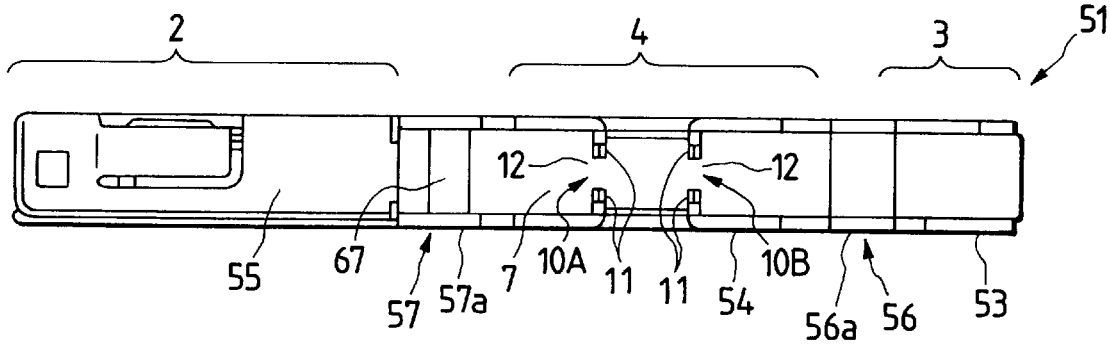
FIGS. 3*a* and 3*b* are a plan view and a side view of the contact terminal of the invention.
Figure 3B:
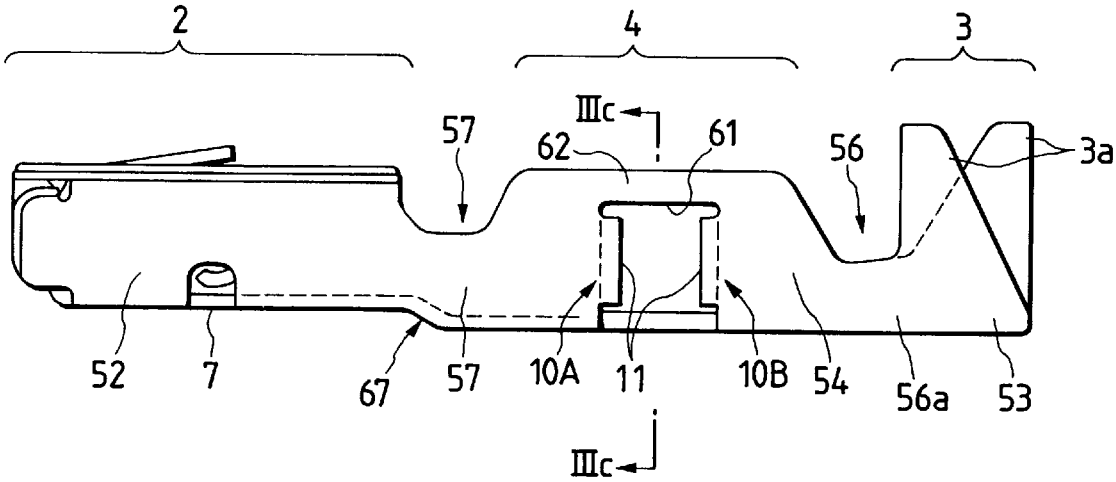
Figure 3C:
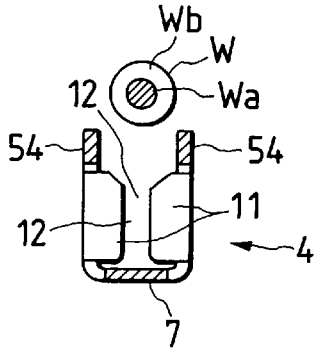
FIG. 3*c* is a sectional view taken along line IIIc—IIIc.

The electrical contact section 2 is engaged with a mating terminal so that the electrical contact section 2 is electrically connected to the mating terminal. The electrical contact section 2 has right and left walls 52, a top wall 55, and a part of the bottom wall 7, and is formed in a box-like shape. The wire clamping section 3 holds a covered wire W (FIG. 3*c*) from the above of the insulating cover Wb. The wire clamping section 3 is U-shaped in section, and has right and left side walls 53 and a part of the bottom wall 7. The right and left side walls 53 have retaining pieces 3*a* at upper end portions thereof, respectively. The wire W is held by bending the retaining pieces 3*a* inwardly. The electrically conductive section 4 is arranged to contact the conductor Wa of the wire W, as shown in FIG. 3*c*. The electrically conductive section 4 is also U-shaped in section, and has right and left side walls 54 and a part of the bottom wall 7. The wire clamping section 3 is coupled to the electrically conductive section 4 through a first coupling section 56 which is U-shaped in section and has a part of the bottom wall 7 and right and left side walls 56*a*. The electrically conductive section 4 is coupled to the electrical contact section 2 through a second coupling section 57 which is also U-shaped in section and has a part of the bottom wall 7 and right and left side walls 57*a*.

As was described above, the bottom wall 7 is extended from the wire clamping section up to the electrical contact section 2 as a piece of common belt-shaped wall. The right side walls 53, 56*a*, 54, 57*a* and 52 are formed with a substantially continuous flat plate, and the left side walls 53, 56*a*, 54, 57*a* and 52 are also formed with a substantially continuous flat plate. In this case, those right and left side walls 53, 56*a*, 54, 57*a* and 52 are extended upwardly from the right and left edges of the common bottom wall 7 by bending upwardly wall plates at right angles.

Figure 4A:
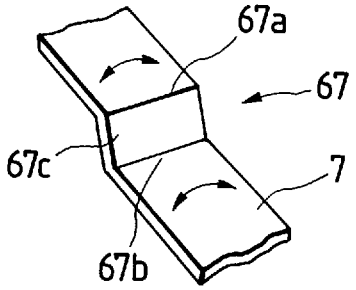
FIGS. 4*a* and 4*b* each show an explanatory diagram for comparison of specific features of the contact terminal of the first embodiment of the invention, with those of a conventional contact terminal; more specifically.
Figure 4B:
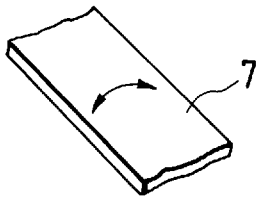

A step 67 stepped in a front-to-rear direction is formed in the bottom wall 7 of the second coupling section 57 through which the electrically conductive section 4 is coupled to the electrical contact section 2. Because of the formation of the step 67, the sectional configuration of the second coupling section 57 as viewed in the longitudinal (front-to-rear)

direction of the bottom wall 7 is not linear, and has a bent portion, as shown in FIG. 4*a*. The step 67 has two bending lines 67*a* and 67*b*, and a slanting surface 67*c* which is inclined with respect to the standard surface of the bottom wall 7. FIG. 4*b* shows a conventional bottom wall which is straight in section. The right and left side walls 57*a*, are upwardly extended continuously from the right and left edges of the part of the common bottom wall 7 where the step 67 is located.

The electrically conductive section 4 has front and rear insulation piercing portions 10A and 10B respectively at the front and rear end portions thereof. Each of the insulation piercing portions 10A and 10B, as shown in FIG. 3*c*, has a pair of right and left insulation piercing blades 11 between which a slot 12 is formed. The right and left side walls 54 of the electrically conductive section have rectangular openings (first openings) 61, respectively. Protrusions extended from the front and rear edges of each of the rectangular openings 61 are bent inwardly, thus forming the aforementioned blades 11 and 11. The wall located above each of the rectangular openings 61 (or a part of the side walls 54) remains as a coupling wall 62, so that the right blades of the front and rear insulation piercing portions 10A and 10B are coupled to each other, and similarly the left blades of the front and rear insulation piercing portions 10A and 10B are coupled to each other.

In the contact terminal 51, the rectangular openings 61 are formed in the side walls 54, respectively, and the protrusions extended from the front and rear edges of each of the opening are formed into the insulation piercing blades 11. Hence, the peripheral portion of each of the side walls 54 remains like a frame, so that the side walls, 53, 56*a*, 54, 57*a*, and 52 are provided as one unit on each of the right and left sides of the contact terminal.

Now, the operation of the contact terminal will be described.

The wire W is connected to the contact terminal as follows: One end portion of the wire W is laid on the rear end portion of the contact terminal 51 in such a manner that the one end portion of the wire W is in parallel with the rear end portion of the contact terminal 51. Under this condition, the one end portion of the wire W is pushed down into the slots 12 from above. Accordingly, the right and left insulation piercing blades cut the insulating cover Wb of the wire W, and are brought into contact with the conductor Wa of the wire W from both sides. When the one end portion of the wire W is further pushed down, the conductor is caused to go in between the right and left blades 11 and is positively held by the right and left blades 11.

In the operation of the one end portion of the wire W being pushed down into the slots 12, a force is applied to the right and left blades 11 to move the right and left blades 11 outwardly (away from each other); however, this movement is prevented for the following reason: In the contact terminal 51, the electrical contact section 2, the electrically conductive section 4, and the wire clamping section 3 have the right and left side walls 52, 54 and 53. The right side walls 52, 54 and 53 are provided as one side wall, and similarly the left side walls 52, 54 and 53 are also provided as one side wall. In addition, the first coupling section 56 through which the electrically conductive section 4 is coupled to the wire clamping section 3 is U-shaped in section, having a part of the bottom wall 7, and the right and left side walls 56*a*; and similarly the second coupling section 57 through which the electrically conductive section 4 is coupled to the electrical contact section 2 is also U-shaped in section, having a part of the bottom wall 7, and the right and left side walls 57*a*. Hence, the contact terminal is high in rigidity as a whole, and the side walls 54 of the electrically conductive section 4 are greatly restricted by the side walls 52 and 54 of the electrical contact section 2 and the wire clamping section 3. In addition, since the electrical contact section 2 is in the form of a box, the restricting force by the side walls 52 of the electrical contact section is considerably great.

Furthermore, the bottom wall 7 of the second coupling section coupled to the electrically conductive section 4 has the step 67. Therefore, as shown in FIGS. 4*a* and 4*b*, the bottom wall 7 is higher in bending rigidity in the horizontal direction (or in the direction of the arrow) than the conventional one, and the supporting force of the electrically conductive section 4 with respect to the side walls 54 is increased as much.

Therefore, even when a force is applied to open the blades 11 of the electrically conductive section 4, the side walls 54 forming the blades 11 are supported by the bottom wall 7 which is increased in rigidity, and are strongly restricted at the front and rear ends; that is, the blades 11 will not be opened outwardly (away from each other).

In the case where the wire W is clamped with the wire clamping section 3 while the wire W is pushed in the electrically conductive section 4, the retaining pieces 3*a* which are the upper end portions of the side walls 53 of the wire clamping section 3 are bent inwardly. Therefore, even if the blades 11 of the electrically conductive section 4 are caused to open outwardly as the wire W is pushed in, the inward force acting on the side walls 53 of the wire clamping section 3, is canceled out by the outward force which the blades 11 of the electrically conductive section 4 applies to the side walls 54, so that the blades 11 are more positively prevented from being opened outwardly.

Accordingly, the right and left side walls 54 of the electrically conductive section 4 are scarcely caused to fall aside, and when the wire W is pushed in the slots 12 of the electrically conductive section 4, the right and left blades 11 are prevented from being outwardly opened. Therefore, even in the case where the width of the blades 11 is decreased to miniaturize the contact terminal, the contact terminal is free from the difficulty that, when the wire is pushed in the slots, the insulating cover Wb is insufficiently cut with the blades 11. Furthermore, the contact load (or holding load) on the conductor Wa of the wire W can be high enough; that is, the electrical connection is improved in reliability.

Particularly, in this case, the step 67 is not formed on the bottom wall 7 of the electrically conductive section 4 so as to directly reinforce the bottom wall, and instead the step 67 is formed on the bottom wall 7 of the second coupling section adjacent thereto, to reinforce the whole bottom wall 7. Hence, in the case where the electrically conductive section 4 is not reinforced, or it is difficult to reinforce the electrically conductive section 4, the blades 11 can be positively prevented from being outwardly opened.

As was described the above, the electrically conductive section 4 has the front insulation piercing portion 10A and the rear insulation piercing portion 10B respectively at the front and rear ends, and the right blades 11 are coupled through the coupling wall 62 to each other, and similarly the left blades 11 are coupled through the coupling wall 62 to each other; that is, the right blades 11 of the front and rear insulation piercing portions 10A and 10B are integral with each other, and similarly the left blades 11 of the front and rear insulation piercing portions 10A and 10B are also integral with each other. Hence, the side walls 54 equally prevent the blades 11 of the two insulation piercing portions 10A and 10B from being opened outwardly. In addition, the side walls 54 of the electrically conductive section 4 have the rectangular openings 61, respectively, and the protrusions extended from the front and rear edges of the rectangular openings 61 are bent inwardly to form the blades 11. Hence, blades 11 high in mechanical resistance whose upper edges are coupled through the coupling walls 62 to each other, can be obtained with ease.

Second Embodiment

Next, a contact terminal of a second embodiment of the invention, will now be described with reference to FIG. 6.

Figure 6:
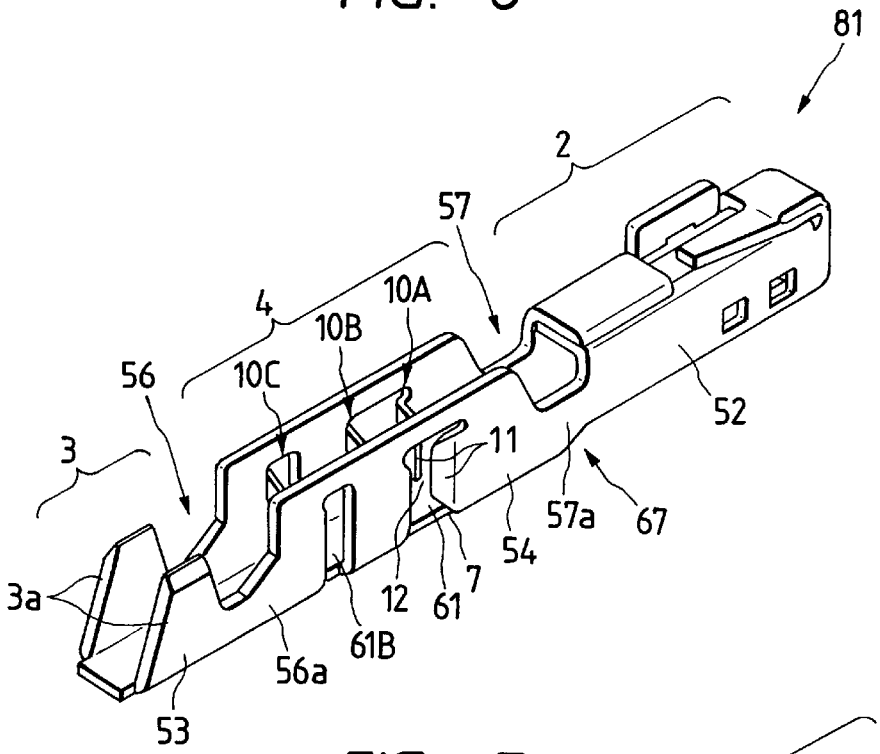
FIG. 6 is a perspective view of the contact terminal of a second embodiment of the invention.
Figure 7:
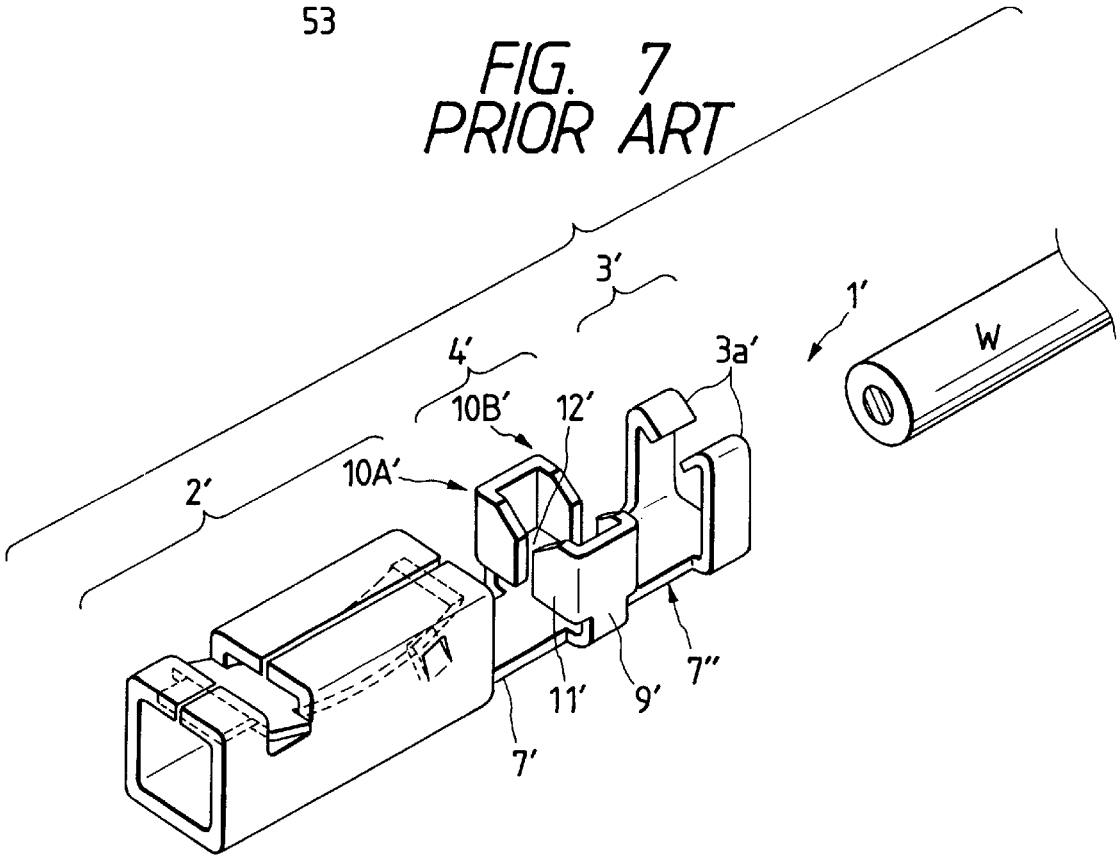
FIG. 7 PRIOR ART
FIG. 7 is a perspective view of a conventional contact terminal.

In FIG. 6, reference numeral 81 designates the contact terminal of the second embodiment of the invention. The contact terminal 81 is substantially similar in structure to the contact terminal 51 of the first embodiment. That is, the contact terminal 81 is different from the contact terminal 51 in the following points: The electrically conductive section 4 has two insulation piercing portions 10A and 10B (hereinafter referred to as "first and second insulation piercing portions 10A and 10B"), and also has a third insulation piercing portion 10C at the rear end portion. The right and left side walls 54 of the electrically conductive section 4 have the openings 61 (hereinafter referred to as "first openings 61"), and second openings 61B behind the first openings. Protrusions extended from the rear edges of the second openings 61B are bent inwardly, to form the blades 11 and the slot 12 of the third insulation piercing portion 10C. The other arrangements are similar to those of the above-described first embodiment. In FIG. 6, parts corresponding functionally to those already described in the first embodiment are therefore designated by the same reference numerals or characters.

In the second embodiment, since the first and second openings 61 and 61B provide the first, second and third insulation piercing portions 10A, 10B and 10C, the wire is more positively held with the contact terminal, and the electrical connection is improved in reliability.

The second opening 61B may be located in front of the first openings 61. In the second embodiment, the third insulation piercing portion 10C is formed by using the rear edges of the second openings 61B; however, it may be formed by using the front edges thereof as a fourth insulation piercing portion. Furthermore, the third and fourth insulation piercing portions may be formed by using both of the front and rear edges of the second openings 61B. The number of insulation piercing portions should be at least one, and the number of openings should be determined according to the number of insulation piercing portions.

In the above-described embodiments, the step 67 is formed at the second coupling section 57; however, the invention is not limited thereto or thereby. That is, it may be formed at the first coupling section 56. Alternatively, if possible, it may be formed at the electrically conductive section.

As was described above, in the contact terminal, the bottom wall near the blades is high in rigidity in the right-to-left direction. Hence, the right and left sides walls of the electrically conductive section scarcely fall aside; that is, when the wire is pushed in the slots of the electrically conductive section, the blades are prevented from being opened outwardly. Hence, in the case, too, where the blades are decreased in width to miniaturize the contact terminal as a whole, the difficulty is eliminated that, when the wire is pushed in the slots, the blades insufficiently cut the insulating cover of the wire. And, the contact load (or holding load) with respect to the conductor of the wire is sufficiently high; that is, the electrical contact of the terminal to the conductor of the wire is considerably high in reliability. Especially, in this case, without formation of the bent portion in the bottom wall of the electrically conductive section, the bottom wall is high in rigidity. Hence, both in the case where the electrically conductive section is not reinforced, and in the case where it is difficult to reinforce the electrically conductive section, the blades are positively prevented from being opened outwardly.

Further, the contact terminal has the following effects in addition to the above. Merely by forming the step in the bottom wall of the coupling section adjacent to the electrically conductive section, the bottom wall is increased in bending rigidity in the right-to-left direction as a whole. Furthermore, the right and left walls are vertically extended from the edges of the bottom wall where the step is formed, so that the junctions of the bottom wall and the side walls is high in rigidity. In addition, the side walls of the electrically conductive section are continuous to those of the coupling sections, and therefore the side walls of the electrically conductive section are restricted by the side walls of the coupling sections. This feature prevents the side walls of the electrically conductive section from falling aside, and accordingly the blades from being opened outwardly.

Further, the contact terminal has the following effects in addition to the above. That is, the side walls of the electrically conductive section has the first openings, and the protrusions extended from the front and rear edges of each of the first openings are bent inwardly to form the blades. Hence, the peripheral portion of each of the side walls 54 remains like a frame. Therefore, the resultant blades are highly resistive against the force of opening them outwardly without increase of the mechanical strength of the side walls. Especially, the front and rear end portions of the side walls have no blades, and therefore the front and rear end portions of the side walls can be made continuous to the side walls of the electrical contact section (the front end portion) and the side walls of the wire clamping section (the rear end portion); that is, the right side walls are provided as one side wall, and the left side walls are also provided as one side wall. This means that the side walls of the contact terminals are high in mechanical strength.

Further, the contact terminal has the following effects in addition to the above. Because of the formation of the first and second openings, at least three blades are arranged in the front-to-rear direction, which increases the wire insulation piercing forces; that is, the electrical connection of the contact terminal is considerably high in reliability.

What is claimed is:

1. A contact terminal, comprising:

an electrically conductive plate including:

a base plate;

an electrical contact section, engageable with another terminal, formed at a front end portion of the base plate;

a wire clamping section, for clamping a wire thereto, formed at a rear end portion of the base plate;

an electrically conductive section formed between the electrical contact section and the wire clamping section, the electrically conductive section including first and second side walls, the first and second side walls which have first and second sets of insulation piercing blades, each of said sets of said blades extending inwardly perpendicular to said first and second side walls to confront each other so as to define a rectangular slot between said blades of each of said sets; and a step portion formed in the base plate between the electrical contact section and the wire clamping section so that a section of the base plate in the step portion in the front-to-rear direction is non-linear, said step portion providing a bending rigidity to the base plate in a horizontal direction and a supporting force to said first and second side walls of said electrically conductive section to prevent each of said sets of said blades from opening outwardly away from each other.

2. The contact terminal of claim 1, wherein the electrical contact section and the electrically conductive section each has a U-shape in section.

3. The contact terminal of claim 1, wherein the electrically conductive section includes a bottom wall which is a part of the base plate and is formed between the first and second side walls, and wherein the electrically conductive section has a U-shape in section.

4. The contact terminal of claim 1, further comprising:

a coupling section provided in one of spaces between the electrically conductive section and the wire clamping section and between the electrically conductive section and the electrical contact section, and the coupling section has the step portion formed in the base plate of the coupling section.

5. The contact terminal of claim 1, wherein the first and second side walls upwardly extend from both side edges of the base plate.

6. The contact terminal of claim 1, wherein the first and second side walls have first openings, respectively, and protrusions extended from front and rear edges of each of the first openings are bent inwardly to form the first set of insulation piercing blades.

7. The contact terminal of claim 6, wherein the first and second side walls further have second openings in such a manner that the second openings are in alignment with the first openings, and protrusions extended from one of a front edge and a rear edge of the second openings are bent inwardly to form the second set of insulation piercing blades.

* * * * *